US005345614A

United States Patent [19]

Tanaka

[11] Patent Number: 5,345,614

[45] Date of Patent: Sep. 13, 1994

[54] VEHICLE HELMET

[75] Inventor: Haruo Tanaka, Ichikawa, Japan

[73] Assignee: Shoei Kako Kabushiki Kaisha, Tokyo, Japan

[21] Appl. No.: 15,847

[22] Filed: Feb. 10, 1993

[30] Foreign Application Priority Data

May 20, 1992 [JP] Japan ..... 4-127388
Dec. 7, 1992 [JP] Japan ..... 4-327034

[51] Int. Cl.[5] ..... A42B 3/02

[52] U.S. Cl. ..... 2/425; 2/424; 2/171.3

[58] Field of Search ..... 2/425, 424, 411, 412, 2/414, 410, 171.3, 5, 6, DIG. 1

[56] References Cited

U.S. PATENT DOCUMENTS

| | | | |
|---|---|---|---|
| 3,783,450 | 1/1974 | O'Connor . | |
| 4,006,496 | 2/1977 | Marker . | |
| 4,115,874 | 9/1978 | Hasegawa | 2/425 |
| 4,519,099 | 5/1985 | Kamiya et al. | 2/425 X |
| 4,555,816 | 12/1985 | Broersma | 2/425 |
| 4,704,746 | 11/1987 | Nava | 2/425 X |
| 5,086,520 | 2/1992 | Arai | 2/425 X |
| 5,136,728 | 8/1992 | Kamata | 2/424 |

FOREIGN PATENT DOCUMENTS

| | | |
|---|---|---|
| 49984/85 | 9/1988 | Australia . |
| 49944/85 | 3/1989 | Australia . |
| 2629986 | 10/1989 | European Pat. Off. . |
| 474939 | 3/1992 | European Pat. Off. . |
| 477150 | 3/1992 | European Pat. Off. . |
| 2050297 | 4/1971 | Fed. Rep. of Germany . |
| 2-6607 | 10/1990 | Japan . |

*Primary Examiner*—Peter Nerbun
*Attorney, Agent, or Firm*—Armstrong, Westerman, Hattori, McLeland & Naughton

[57] ABSTRACT

A vehicle helmet, including a cap body comprised of a shell and a shock absorbing liner fitted to an inner surface of the shell, and a longitudinally extending air duct which is provided in a wall of of the cap body, such that the inside of the cap body can be ventilated through the air duct, wherein at least a portion of the shock absorbing liner is divided into an outer layer on the side of the shell, and an inner layer superposed on an inner surface of the outer layer, the inner and outer layers having recessed grooves provided in opposed surfaces thereof to define an air duct, the inner layer having a vent hole. Thus, air-stream flowing into the air duct can flow at a high rate without any leakage, thereby reliably performing a ventilation of the inside of the cap body.

9 Claims, 9 Drawing Sheets

VEHICLE HELMET

BACKGROUND OF THE INVENTION

1. Field of the Invention

The present invention relates to an improvement in a vehicle helmet, including a cap body comprised of a shell and a shock absorbing liner fitted in the shell, and a longitudinal air duct which extends in a wall of of the cap body, such that the interior of the cap body can be ventilated through the air duct.

2. Description of the Prior Art

There is such a helmet conventionally known, for example, from Japanese Patent Publication No. 1118/74, which includes an air duct formed in a groove-like fashion in the shock-absorbing liner at a surface opposed to the shell. With the helmet having such a structure, the air duct cannot be clogged with wearer's hairs, leading to a good ventilation, as compared with the helmet having an air duct provided in the shock absorbing liner at an inner surface, that is, a surface opposed to the wearer's head.

However, it has been found that the ventilating ability of such helmet, in practice, may be lower against expectation, which is due to the following reason.

Shell of helmets is made of FRP in recent years and has an inner surface which is crude due to the exposure of a reinforcing fiber. For this reason, there are fine clearances in anywhere between the shell and the shock absorbing liner, and if these clearances come into communication with the air duct, air-stream leaks out from the air duct and the flow rate thereof is reduced in the air duct, resulting in a degraded ventilative ability.

SUMMARY OF THE INVENTION

Accordingly, it is an object of the present invention to provide a helmet of the type described above type for use in riding on a vehicle, which has a good ventilative ability.

To achieve the above object, according to the present invention, at least a portion of the shock absorbing liner is divided into an outer layer on the side of the shell, and an inner layer superposed on an inner surface of the outer layer, the inner and outer layers having recessed grooves provided in opposed surfaces thereof to define an air duct the inner layer having a vent hole communicating with said air duct and opened to an interior of the cap body.

With the above construction, a peripheral edge of the groove-like air duct can be sealed by superposed surfaces of the inner and outer layers, and the presence of clearances between the opposed surfaces of the shell and the shock absorbing liner has nothing to do with such sealing. Therefore, air-stream flows through the air duct at a high rate without any leakage, thereby reliably performing the ventilation of the interior of the cap body through the vent hole in the inner layer. In addition, it is possible to prevent heating of the air duct by a solar heat by means of the outer layer, thereby providing a comfortable ventilated condition even in the summer season.

The above and other objects, features and advantages of the invention will become apparent from the following description of preferred embodiments, taken in conjunction with the accompanying drawings.

DESCRIPTION OF THE PREFERRED EMBODIMENTS

The present invention will now be described by way of a first embodiment.

Figure 1:
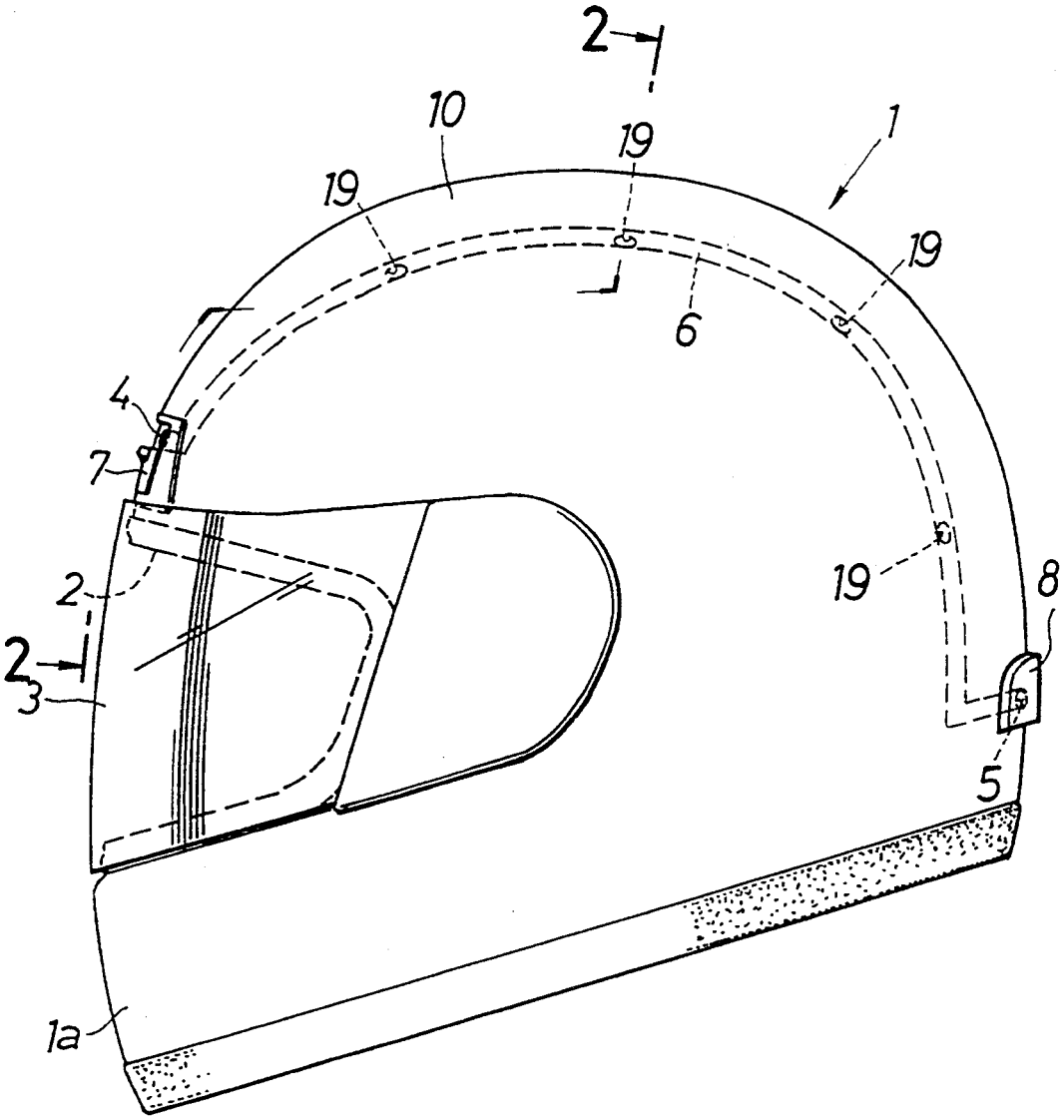
FIG. 1 is a side view of a helmet according to a first embodiment of the present invention.

Referring to FIG. 1, a cap body 1 is constructed into a full-face type including a chin covering portion la immediately below a window opening 2 in a front wall thereof. A shield 3 is pivotally supported at opposite ends on left and right opposite sides of the cap body 1 in such a manner to open and close the window opening 2.

Provided in an outer surface of the cap body 1 are a pair of left and right inlet ports 4, 4 opened immediately above the window opening 2, and a pair of outlet ports 5, 5 opened in rear and lower portions of the cap body 1. The cap body 1 is provided with air ducts 6, 6 each interconnecting the inlet port 4 and the outlet port 5 on each side.

Figure 2:
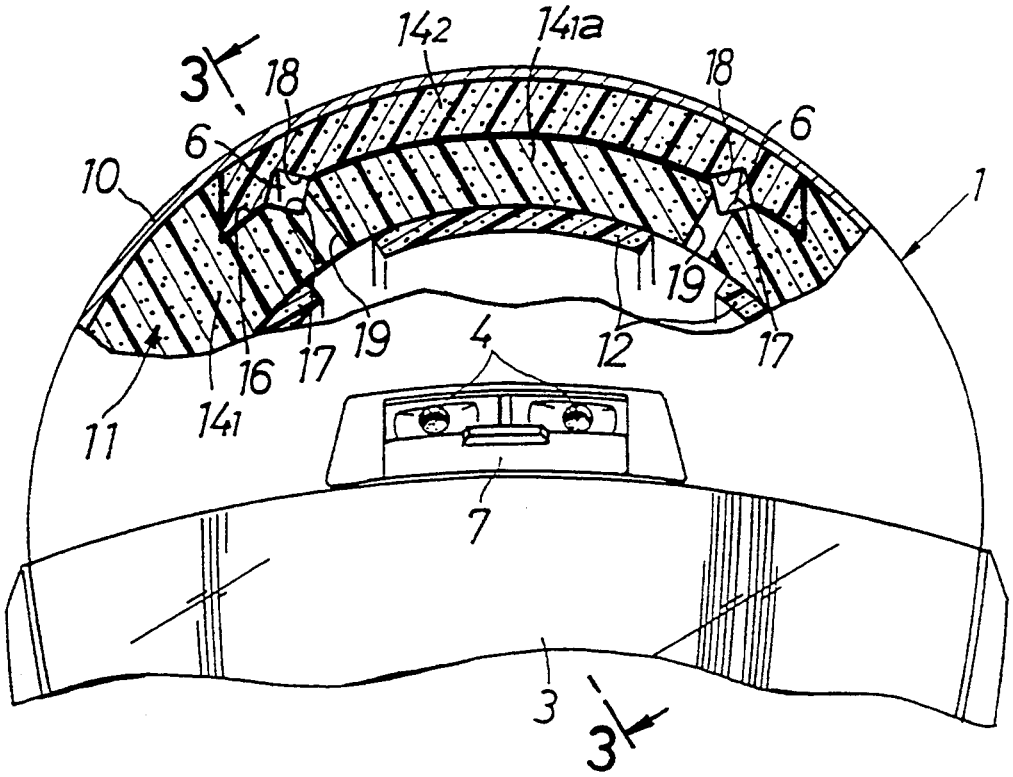
FIG. 2 is an enlarged sectional view taken along a line 2—2 in FIG. 1.
Figure 3:
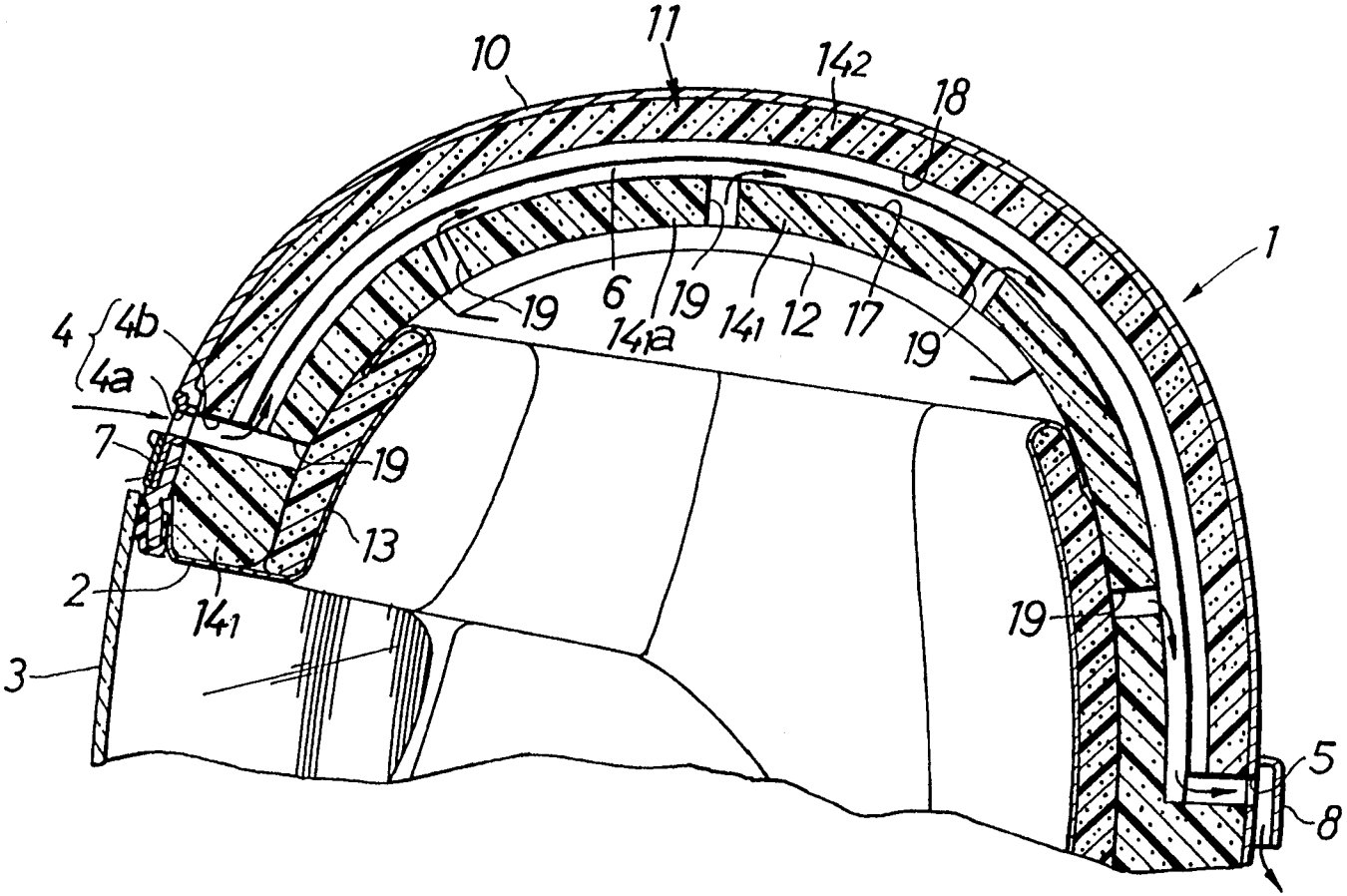
FIG. 3 is a sectional view taken along a line 3—3 in FIG. 2.

Referring to FIGS. 2 and 3, the cap body 1 is comprised of a shell 10 made of FRP, and a shock absorbing liner 11 of an expanded polystyrene fitted in the shell 10. A top pad 12 and a fit pad 13 each made of urethane foam and having an air-permeability or breathability are attached to an inner surface of the liner 11.

Figure 4:
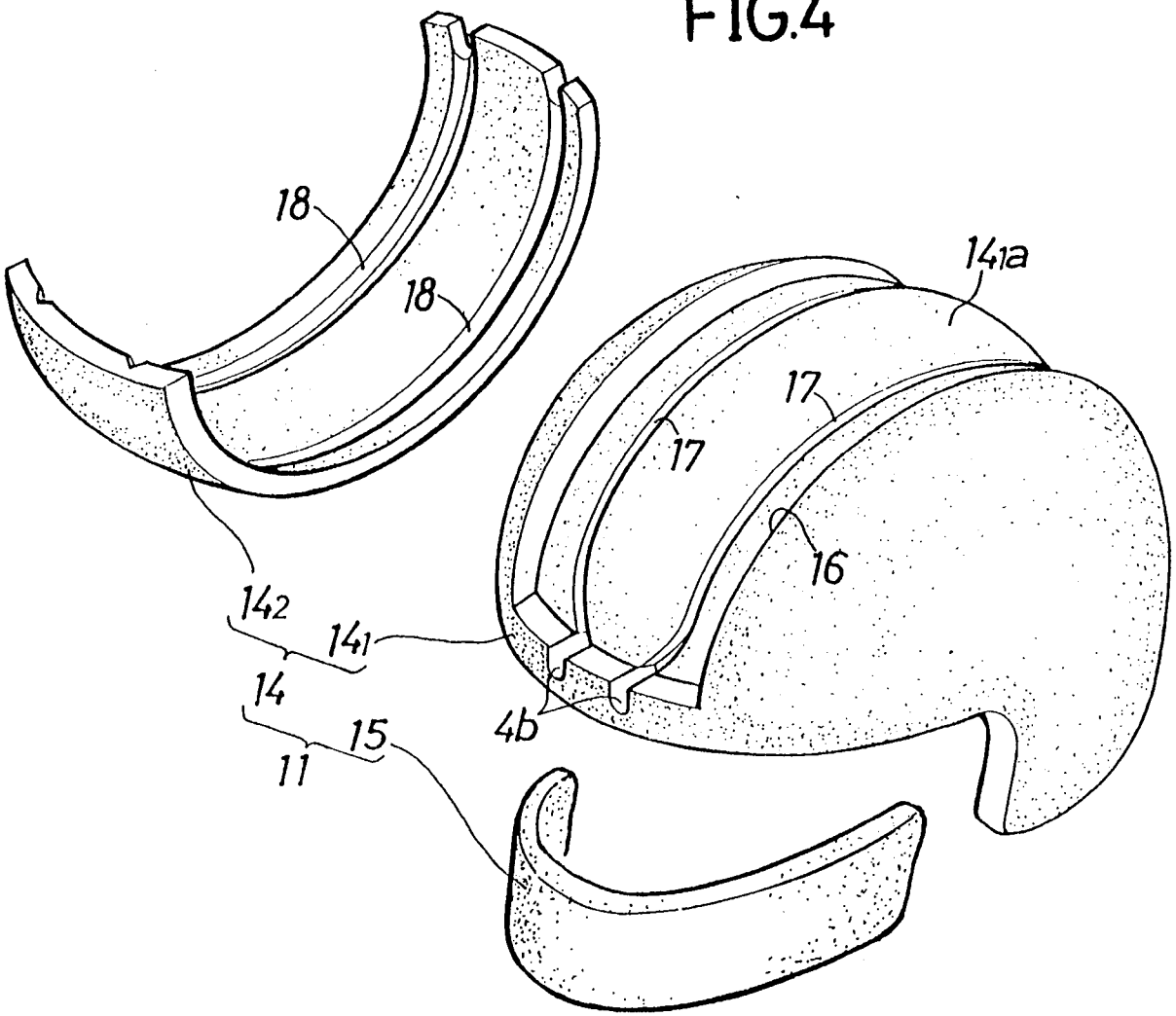
FIG. 4 is an exploded perspective view of a shock absorbing liner of the helmet.
Figure 5:
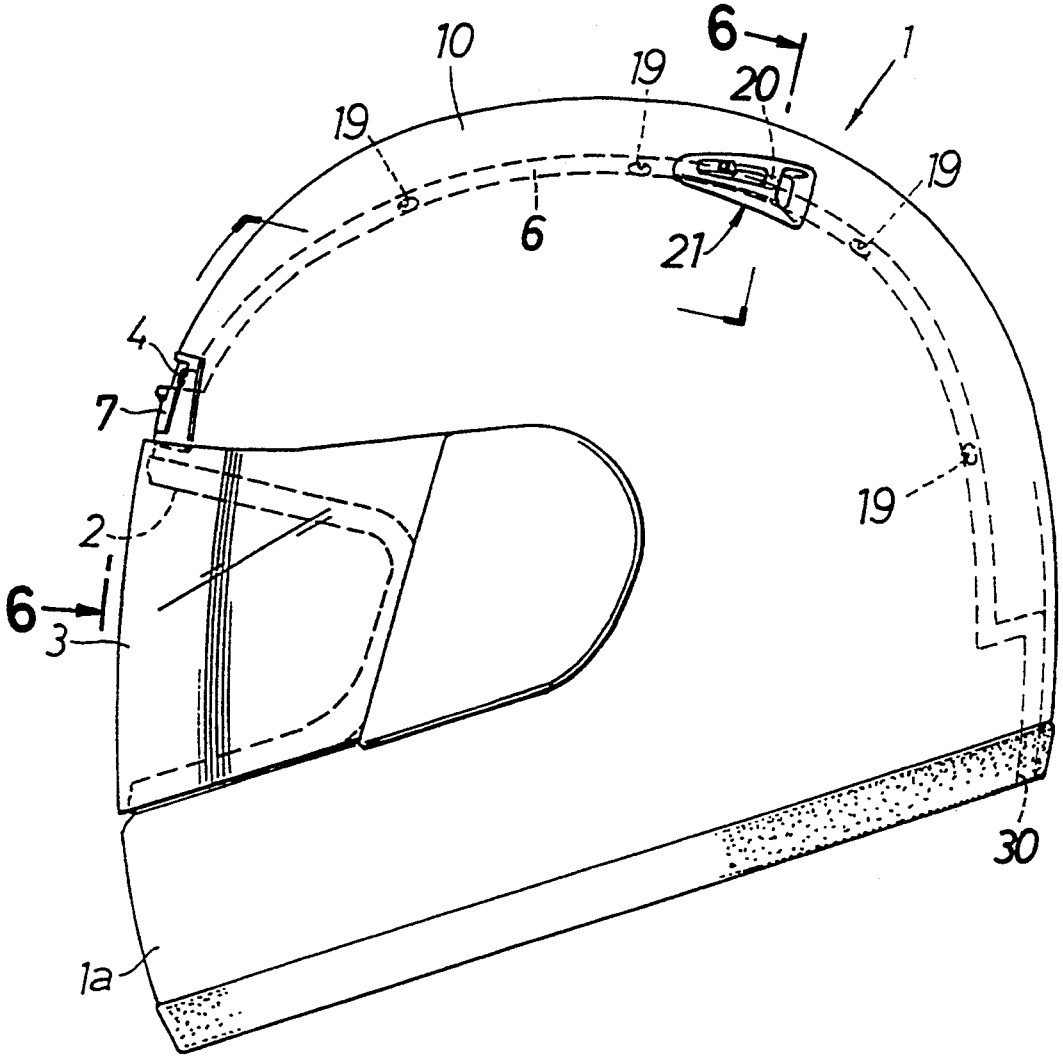
FIG. 5 is a side view of a helmet according to a second embodiment of the present invention.
Figure 6:
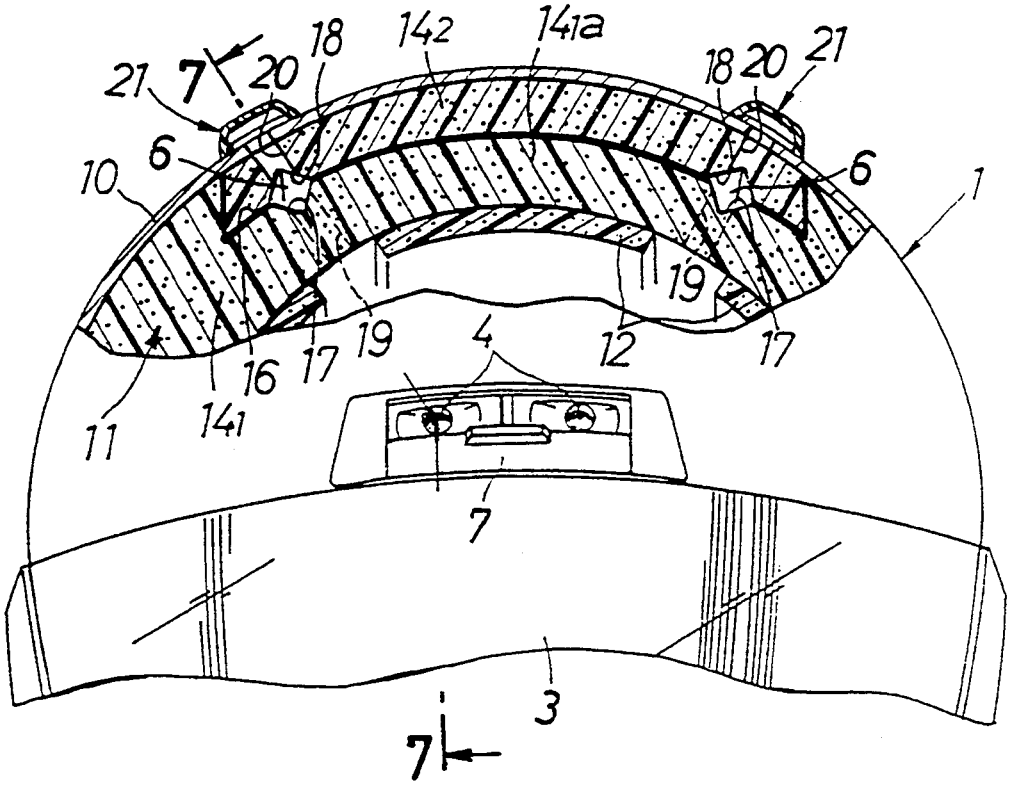
FIG. 6 is an enlarged sectional view taken along a line 6—6 in FIG. 5.
Figure 7:
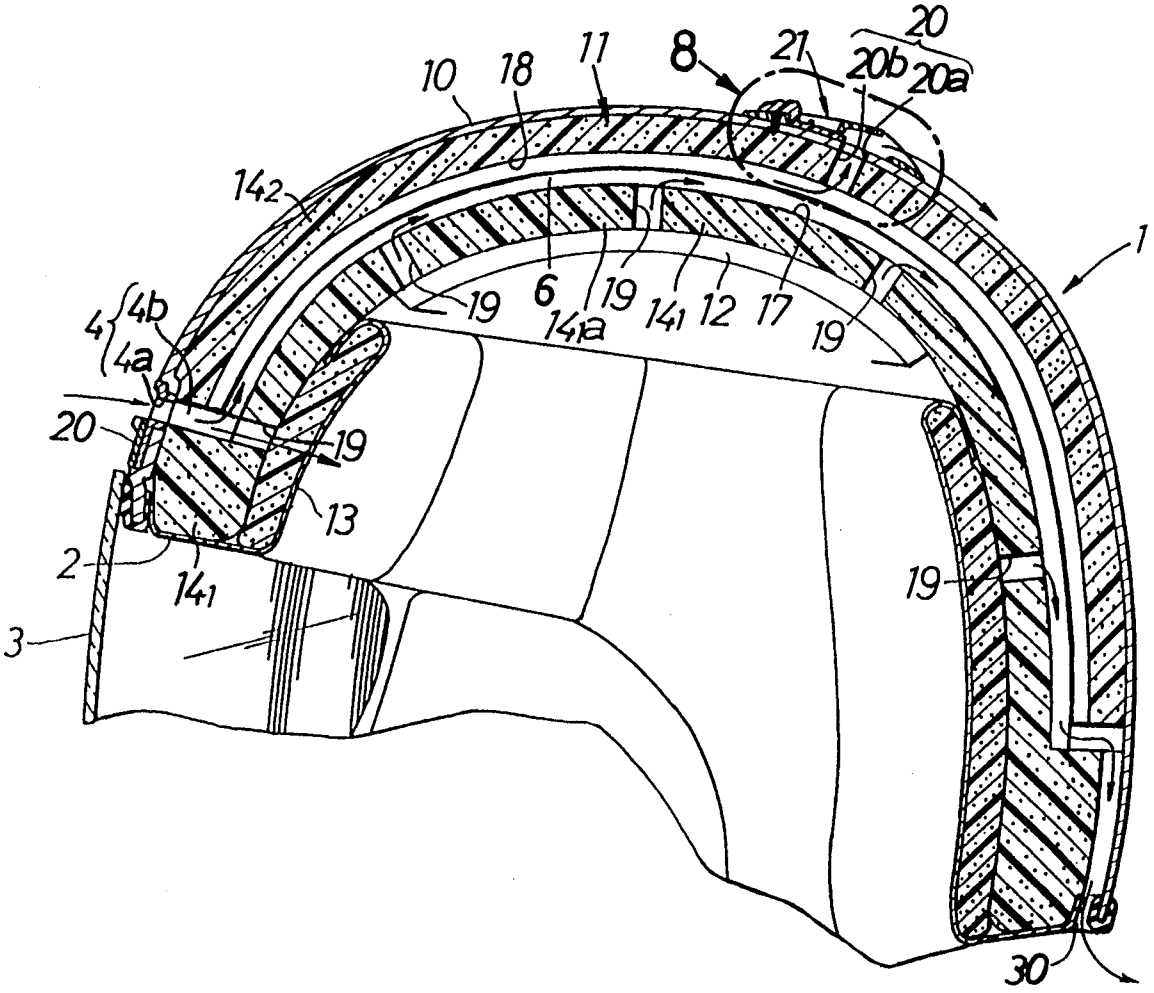
FIG. 7 is an enlarged sectional view taken along a line 7—7 in FIG. 6.

As shown in FIG. 4, the shock absorbing liner 11 is divided into a main liner section 14 fitted to a main portion of the shell 10 excluding the chin-covering portion 1*a*, and a chin-covering portion liner section 15 fitted to the chin-covering portion la of the shell 10. Further, as shown in FIGS. 2 to 4, the main liner section 12 is divided into a main liner body $\mathbf{14}_1$ provided in an upper surface thereof with a groove-like recess 16 extending along the longitudinal center line of the cap body 1, and an outer layer $\mathbf{14}_2$ fitted into the recess 16. A portion of constituting a bottom wall of the recess 16 in the main liner body $\mathbf{14}_1$ corresponds to an inner layer $\mathbf{14}_1a$. The outer layer $\mathbf{14}_2$ has an expansion ratio which is set smaller than that of the inner layer $\mathbf{14}_1a$, i.e., of the main liner body $\mathbf{14}_1$. Therefore, the outer layer $\mathbf{14}_2$ has a density higher than that of the main liner body $\mathbf{14}_1$.

Recessed grooves 17, 17; 18 18 are provided in opposed surfaces of the inner layer $\mathbf{14}_1$ and the outer layer $\mathbf{14}_2$ to constitute the air ducts 6, 6, respectively. A plurality of air vent holes 19, 19—are provided in the inner layer $\mathbf{14}_1a$ to permit the communication of each of the air ducts 6 with an interior of the cap body 1. Each of the inlet ports 4 is comprised of a through hole 4*a* extending through a front wall of the shell 10 to communicate with a front end of the corresponding air duct 6, and a notch 4*b* (FIG. 4) provided in a front end wall of the recess 16 in the main liner body $\mathbf{14}_1$.

The left and right inlet ports 4, 4 are disposed in proximity to each other at a central portion of a front surface of the cap body Thus, the left and right inlet ports 4, 4 can be opened and closed by a single common inlet shutter 7 attached to the shell 10, and air-stream can be effectively introduced through the central portion of the front surface of the cap body 1. A space between the left and right air ducts 6, 6 is likewise set narrower at their front ends communicating with the inlet ports 4, 4, but becomes gradually wider as the ducts 6, 6 extend rearwardly from the inlet ports 4, 4, thereby permitting a ventilation to be produced in an increased extent within the cap body 1.

A cover 8 opened at its lower portion is mounted on the outer surface of the cap body 1 to cover an externally opened end of each of the outlet ports 5.

The operation of this embodiment of the present invention will be described below.

If a driver of a vehicle, e.g., motorcycle wears the cap body 1 on his head, and opens the inlet shutter 7 to open the inlet ports 4, 4 during travelling of the motorcycle, air-stream generated upon travelling of the vehicle exerts a dynamic pressure to the inlet ports 4, 4, and flowing of the air-stream along the outer surface of the cap body 1 causes a negative pressure at the rear portion of the cap body 1 the negative pressure exerts to the outlet ports 5, 5.

The air-stream flows from the inlet port 4, 4 through the air ducts 6, 6 toward the outlet ports 5, 5 by the application of such dynamic and negative pressures.

Peripheral edges of the recessed grooves 17 and 18 constituting each of the air ducts 6 are reliably sealed by the inner and outer layers $\mathbf{14}_1a$ and $\mathbf{14}_2$ fitted with each other. Therefore, the air-stream flowing into each of the air ducts 6 is not leaked and thus, can pass through the air duct 6 at a high rate.

According to the system of such flowing of the air-stream through the air duct 6, in the air vent hole 19 closer to the inlet port 4, air is introduced through the air duct 6 into the interior of the cap body 1, and in the other air vent hole 19, air warmed in the interior of the cap body 1 is sucked into the air duct 6, as shown by an arrow in FIG. 3, thereby effectively ventilating the interior of the cap body 1. The intensity of the ventilation can be controlled by adjusting the opening degree of the inlet shutter 7.

If a shock force is applied to a top of the outer surface of the cap body 1 due to a fall-down trouble of the motorcycle or the like, a relatively small shock energy can be absorbed by the inner layer $\mathbf{14}_1a$ of the lower density, while a relatively large shock energy can be absorbed by the outer layer $\mathbf{14}_2$ of the higher density and as a result, the transmission of the shock force to the driver's head can be moderated effectively.

It will be understood that various modifications in design can be made in the above-described embodiment without departing from the principle of the present invention. For example, the recessed groove 17 or 18 may be provided as the air duct 6 only in one of the opposed surfaces of the inner and outer layers $\mathbf{14}_1a$ and $\mathbf{14}_2$. In addition, the present invention is applicable to another type of a helmet such as a jet type and the like.

A second embodiment of the present invention will now be described, wherein parts or components corresponding to those in the first embodiment are designated by the same reference characters as in the first embodiment, and the detailed description thereof is omitted herein.

In the second embodiment, the above-described outlet ports are replaced by a pair of first left and right outlet ports 20, 20 provided in the outer surface of the cap body 1 and opened at the top thereof, and a pair of second left and right outlet ports 30, 30 also provided in the outer surface of the cap body 1 and opened at the lower surface of the rear portion thereof. The ports 20 and 30 on the same side are connected to a pair of corresponding left and right air ducts 6, 6, respectively.

Each of the first outlet ports 20 is comprised of through-holes 20*a* and 20*b* which extend through the tops of the shell 10 and the outer layer $\mathbf{14}_2$ so as to communicate with an intermediate portion of the corresponding air duct 6. Each of the second outlet ports 30 is comprised of a groove formed in the lower portion of the back surface of the liner body $\mathbf{14}_1$ so as to communicate with a rear end of the corresponding air duct 6.

The first outlet ports 20, 20 are opened and closed by outlet shutters 21, 21 independently operated, respectively.

Figure 8:
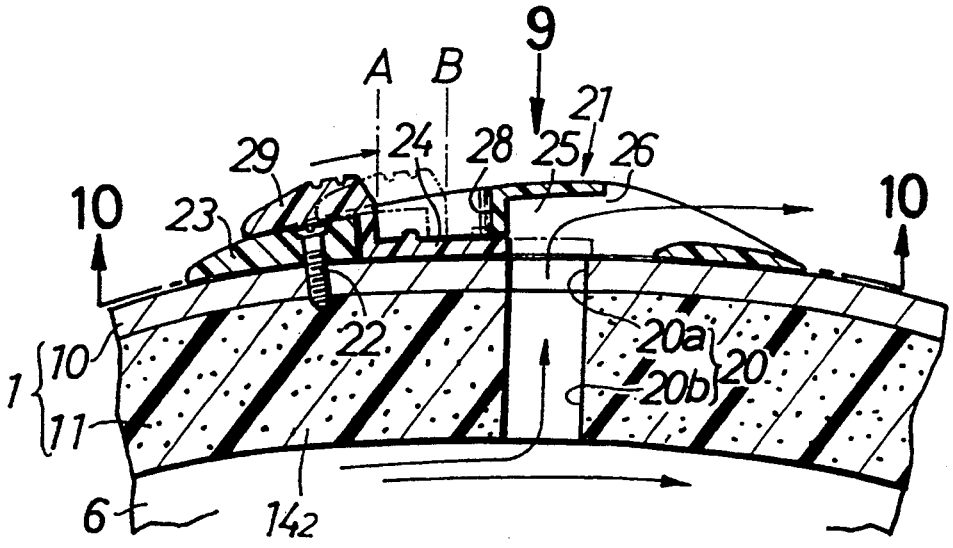
FIG. 8 is an enlarged view of a portion indicated by 8 in FIG. 7.
Figure 9:
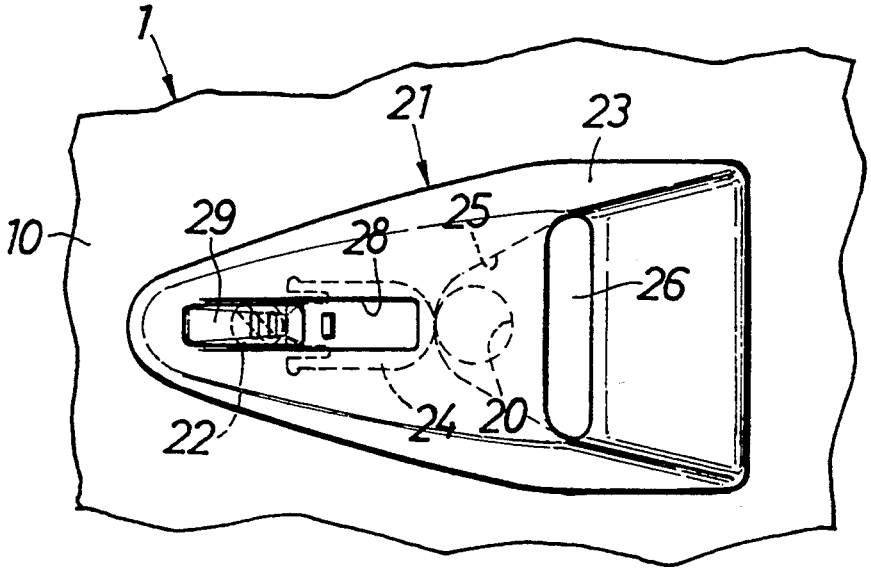
FIG. 9 is a view taken along an arrow 9 in FIG. 8.
Figure 10:
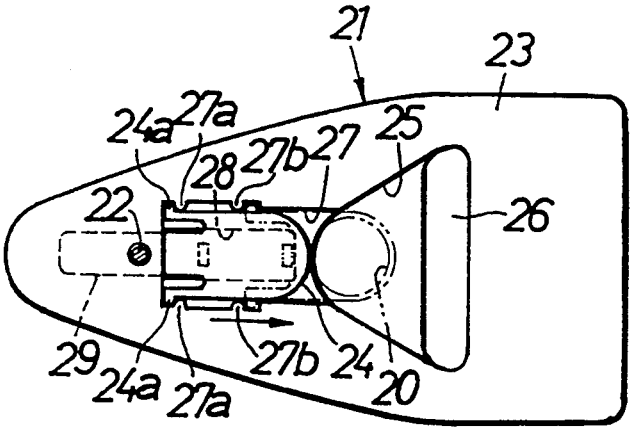
FIG. 10 is a sectional view taken along a line 10—10 in FIG. 8.

Each of the outlet shutters 21 is comprised of a shutter housing 23 secured to the outer surface of the shell 10 by a machine screw 22, and a shutter plate 24 slidably carried on the shutter housing 23 for opening and closing an outer opened end of the first outlet port 20, as shown in FIGS. 8 to 10. The shutter housing 23 is generally in a flat and streamline form and is provided with a small chamber 25 into which an upper end of the first outlet port 20 is opened, and a flow-out opening 26 through which the small chamber 25 is opened rearwardly. The flow-out opening 26 is divergent rearwardly. The shutter housing 23 is also provided with a guide groove 27 extending forwardly from the small chamber 25, and an elongated hole 28 opened into the guide groove 27. The shutter plate 24 is slidably received in the guide groove 27, and a knob 29 formed on a front end of the shutter plate 24 is slidably received in the elongated hole 28.

The shutter plate 22 includes a pair of left and right resilient claws 24*a*, 24*a*. And two pairs of front and rear projections 27*a*, 27*a*, 27*b* and 27*b* are formed on left and right sidewalls of the guide groove 27 for engagement with the resilient claws 24*a*, 24*a* to retain the shutter plate 22 alternately at a front opened position A and a rear closed position B. The shutter plate 22 opens the first outlet port 20 at its opened position A, and closes the port 20 at its closed position B.

The operation of the second embodiment will be described below.

If a driver of the vehicle, e.g., a motorcycle wears the cap body 1 on his head, and opens the inlet shutter 7 to open the inlet ports 4, 4 during travelling of the vehicle, air-stream exerts a dynamic pressure to the inlet ports 2, 2. Flowing of the air-stream along the outer surface of the cap body 1 causes a negative pressure at the rear portion of the cap body 1 the negative pressure exerts to the outlet ports 5, 5. A negative pressure is generated in the flow-out opening 26 in the outlet shutter 21 and the second outlet port 30. The negative pressure generated in the flow-out opening 26 is applied through the small chamber 25 to the first outlet port 20. The application of such dynamic pressure and the negative pressure causes the air-stream to flow from the inlet ports 4, 4 through the air ducts 6, 6 toward the first and second outlet ports 20 and 30.

Particularly, since the first and second outlet ports 20 and 30 are provided in the top and the lower end of the rear portion of the cap body 1, even if the angle of forward inclination of the cap body 1 is varied in any way due to a variation in attitude of the driver, a strong negative pressure can be always generated in either one of the first and second outlet ports 20 and 30 and thus, the interior of the cap body 1 can be always ventilated effectively.

The degree of the ventilation within the cap body 1 can be finely adjusted by closing either one, two or all of the inlet shutter 7 and the outlet shutters 21, 21.

It will be understood that various modifications in design can be made in the second embodiments without departing from the principle of the present invention. For example, a shutter may be provided even over the second outlet port 6 for opening and closing the latter.

What is claimed is:

1. A vehicle helmet comprising:

a cap body comprised of a shell and a shock absorbing liner fitted in the shell;

a longitudinal air duct which extends in the shock absorbing liner of the cap body, such that the interior of the cap body can be ventilated through the air duct, wherein at least a portion of said shock absorbing liner is divided into an outer layer facing an inner surface of the shell, and an inner layer superposed on an inner surface of the outer layer, at least one of said inner and outer layers having a recessed groove provided in an opposed surface thereof to define the air duct, said inner layer having a vent hole communicating with said air duct and opened to the interior of the cap body, and said shock absorbing liner comprises a liner body having a recess in an outer surface thereof, and said outer layer, and wherein said inner layer forms a bottom wall of said recess and said outer layer is fitted into said recess so as to be superposed on said inner layer.

2. A vehicle helmet according to claim 1, wherein said shock absorbing liner is made of expanded polystyrene, and said outer layer has a higher density that said inner layer.

3. A vehicle helmet according to claim 1, wherein said cap body includes an inlet port having a shutter and opened into a front surface of the cap body to communicate with a front end of said air duct, an outlet port opened into a rear and lower portion of the cap body to communicate with a rear end of said air duct, and a through hole opened into an intermediate surface of the cap body to communicate with said air duct.

4. A vehicle helmet according to claim 3, wherein said inlet and outlet ports are defined by recessed grooves provided in opposed surfaces of said inner and outer layers.

5. A vehicle helmet according to claim 1, wherein said cap body is provided at a front portion thereof with an inlet port for introducing the open-air into said air duct, and is also provided at a top portion and a rear portion of the cap body with first and second outlet ports for drawing the inside-air out of said air duct.

6. A vehicle helmet according to claim 5, wherein a pair of the left and right inlet ports are disposed in proximity to each other at a central portion of the front surface of said cap body, and the left and right air ducts communicating with said inlet ports are formed such that a distance between the air ducts becomes gradually larger toward a rearward direction from said inlet ports.

7. A vehicle helmet according to claim 6, further including a single common inlet shutter capable of opening and closing the pair of left and right inlet ports.

8. A vehicle helmet according to claim 6, further including a pair of left and right outlet shutters mounted to at least one of a pair of the first outlet ports and a pair of the second outlet ports communicating with said left and right air ducts, said shutters being capable of independently opening and closing said outlet ports.

9. A vehicle helmet comprising:

a cap body comprised of a shell and a shock absorbing liner fitted in the shell;

a longitudinal air duct which extends in the shock absorbing liner of the cap body, such that the interior of the cap body can be ventilated through the air duct, wherein at least a portion of said shock absorbing liner is divided into an outer layer facing an inner surface of the shell, and an inner layer superposed on the inner surface of the outer layer, at least one of said inner and outer layers having a recessed groove provided in an opposed surface thereof to define the air duct, said inner layer having a vent hole communicating with said air duct and opened to the interior of the cap body, and said cap body is provided at a front portion thereof with an inlet port for introducing the air into said air duct, and is also provided at a top portion and a rear portion of the cap body with first and second outlet ports, respectively, for drawing the inside-air out of said air duct.

* * * * *